US010850315B2

(12) United States Patent
Han et al.

(10) Patent No.: US 10,850,315 B2
(45) Date of Patent: Dec. 1, 2020

(54) HIGH-TOUGHNESS AND PLASTICITY HYPEREUTECTOID RAIL AND MANUFACTURING METHOD THEREOF

(71) Applicant: Pangang Group Research Institute Co., Ltd., Chengdu (CN)

(72) Inventors: Zhenyu Han, Chengdu (CN); Ming Zou, Chengdu (CN); Hua Guo, Chengdu (CN); Jun Yuan, Chengdu (CN)

(73) Assignee: Pangang Group Research Institute Co., Ltd., Chengdu (CN)

( * ) Notice: Subject to any disclaimer, the term of this patent is extended or adjusted under 35 U.S.C. 154(b) by 242 days.

(21) Appl. No.: 16/155,102

(22) Filed: Oct. 9, 2018

(65) Prior Publication Data

US 2019/0105693 A1 Apr. 11, 2019

(30) Foreign Application Priority Data

Oct. 10, 2017 (CN) ..... 2017 1 0934069

(51) Int. Cl.

| | |
|---|---|
| ***B21B 1/085*** | (2006.01) |
| ***B21B 1/22*** | (2006.01) |
| ***C21D 1/667*** | (2006.01) |
| ***C21D 9/04*** | (2006.01) |
| ***C22C 38/02*** | (2006.01) |
| ***C22C 38/04*** | (2006.01) |
| ***C22C 38/26*** | (2006.01) |
| ***C22C 38/28*** | (2006.01) |
| ***C22C 38/24*** | (2006.01) |

(52) U.S. Cl.

CPC ..... *B21B 1/085* (2013.01); *B21B 1/22* (2013.01); *C21D 1/667* (2013.01); *C21D 9/04* (2013.01); *C22C 38/02* (2013.01); *C22C 38/04* (2013.01); *C22C 38/24* (2013.01); *C22C 38/26* (2013.01); *C22C 38/28* (2013.01); *B21B 2001/225* (2013.01); *C21D 2211/001* (2013.01); *C21D 2211/003* (2013.01); *C21D 2211/005* (2013.01); *C21D 2211/009* (2013.01)

(58) Field of Classification Search

CPC .. C21D 9/04; B21B 1/085; B21B 1/22; C22C 38/00

See application file for complete search history.

(56) References Cited

U.S. PATENT DOCUMENTS

2011/0253268 A1* 10/2011 Zou ..... C22C 38/04 148/584

FOREIGN PATENT DOCUMENTS

| | | |
|---|---|---|
| CN | 101646795 A | 2/2010 |
| CN | 103898303 A | 7/2014 |
| CN | 105483347 A | 4/2016 |

OTHER PUBLICATIONS

Partial Translation for CN 101646795 A (2010).
Translation for CN 103898303 A (2014).
English Abstract for CN 105483347 A (2016).

* cited by examiner

*Primary Examiner* — Christopher S Kessler
*Assistant Examiner* — Jiangtian Xu
(74) *Attorney, Agent, or Firm* — Caesar Rivise, PC

(57) ABSTRACT

Provided is a manufacturing method for high-toughness and plasticity hypereutectoid rail, including: a. hot rolling the steel billet into rail; b. blowing a cooling medium to the top surface of railhead, wherein, the two sides of railhead and the lower jaws on the two sides of railhead after the center of top surface of rail is air-cooled to 800-850° C., and cooling the rail until the center temperature of the top surface is 520-550° C.; c. stop blowing the cooling medium to the lower jaws on the two sides of railhead, continue blowing the cooling medium to the top surface of railhead and the two sides of railhead, and air cool the rail to room temperature after the surface temperature of railhead is cooled to 430-480° C. The resulting hypereutectoid rail has higher toughness and plasticity than existing products, which is suitable for heavy-haul railway, especially for small radius curve sections.

5 Claims, No Drawings

HIGH-TOUGHNESS AND PLASTICITY HYPEREUTECTOID RAIL AND MANUFACTURING METHOD THEREOF

CROSS-REFERENCE TO RELATED APPLICATIONS

This application claims priority from CN 201710934069.5, filed Oct. 10, 2017, the contents of which are incorporated by reference in their entireties.

FIELD OF INVENTION

The invention relates to a rail, particularly a high-toughness and plasticity hypereutectoid rail and its manufacturing method.

BACKGROUND OF THE INVENTION

The rapid development of railway has proposed higher requirements for the service performance of rail. With the continuous improvement of China's high-speed railway network, heavy-haul transformation will be conducted gradually for the existing main railway lines with passenger and freight mixed traffic. And the heavy-haul railway will develop towards large volume, high axle load and high density. As a key component of railway, the quality and performance of rail is closely related to the transport efficiency of railway and the safety of traffic. With the improvement of the transportation capacity of railway, the service environment of rail has become increasingly harsh and complex and all kind of defects and failures have occurred. Some rails at small radius curves have defects and failures such as rapid abrasive wear and peeling-off simultaneously, making their service life inconsistent with that of the main line rails, thus limiting the further development of railway transportation.

Currently, the method of on-line or off-line heat treatment for pearlitic rail is mainly adopted to improve the performance of the rail at curves. By blowing compressed air or water-air spray mixture to the railhead of austenitic rail, the railhead is rapidly cooled, and it is able to produce refined and lamellar perlite structure from the surface of the railhead to a certain depth. The strength and toughness of rail can be improved synchronously through grain refinement, so that the wear resistance and contact fatigue resistance can be improved simultaneously. In terms of accelerated cooling process, few research reports on the influence of cooling nozzle layout to the performance of rail are available at home or abroad.

Patent CN101646795B, Internal High-Hardness Type Pearlitic Rail with Excellent Wear Resistance and Fatigue Damage Resistance and Manufacturing Method Thereof, specifies a manufacturing method for an internal high-hardness pearlitic rail, characterized in that, the steel is hot rolled into rail shape with a final rolling temperature of 850-950° C., and the surface of railhead is rapidly cooled from the temperature above the pearlitic transformation temperature to 400-650° C. at a rate of 1.2-5° C./s. The patent only specifies the temperature to start and end cooling as well as the corresponding range of cooling rate at different stages of heat treatment for rail, but does not specify any cooling method.

Patent CN105483347A discloses A Heat Treatment Technique for Hardening Pearlitic Rail, characterized in that a rail is heated to 880-920° C. and insulated for 10-15 min, and then cooled to specific temperature range at specific range of cooling rate according to different steel types and insulated for 30 s, and then air-cooled, with specific conditions as follows: the process for hardening U75V pearlitic rail is: to insulate the rail at 880-920° C. for 10-15 min, and cool the rail to 570-600° C. at a cooling rate of 8-15° C./s, and then air cool the rail to 20-25° C. at a cooling rate of 0.2-0.5° C./s; the process for hardening U76CrRE pearlitic rail is: to insulate the rail at 850-900° C. for 10-15 min, and cool the rail to 590-610° C. at a cooling rate of 6-10° C./s, and then air cool the rail to 20-25° C. at a cooling rate of 0.2-0.5° C./s. The heat treatment technique for the two grades of materials, i.e. U75V and U76CrRE, disclosed by the patent also does not specify any cooling method.

Patent CN103898303A discloses A Heat Treatment Method for Turnout Rail and Turnout Rail, characterized in that, accelerated cooling is carried out for a turnout rail to be treated with temperature of the top surface of the railhead of 650-900° C. to get the turnout rail with fully pearlitic structures, wherein, the accelerated cooling rate of the working side of the railhead of the turnout rail is higher than that of the non-working side of the railhead of the turnout rail, with a difference of 0.1-1.0° C./s. The patent specifies the benefits of different cooling rates on two sides of the railhead for the rail, especially for improving performance and controlling flatness of the rail with asymmetric section, but it does not clarify the influence of nozzle layout and cooling rate at different stages to the performance of rail after heat treatment. In prior art, the heat treatment for rail is mainly focused on controlling different cooling rates in different temperature ranges to control heat treatment processes, it does not relate to refined control such as various nozzle layout and blowing method, therefore, no high-toughness and plasticity hypereutectoid rail can be obtained.

SUMMARY OF THE INVENTION

The technical problem to be solved by the invention is that: in prior art, the method adopting different cooling rates in different temperature ranges is used for heat treatment of rail, therefore the pearlitic rail obtained has poor performance.

The technical scheme of the invention to solve the technical problem is to provide a manufacturing method for a high-toughness and plasticity hypereutectoid rail, comprising the following steps:

a. Rolling of rail to hot roll steel billet into rail, with a final rolling temperature range of 900-1000° C.;

b. Cooling stage I to blow a cooling medium to the top surface of railhead, the two sides of railhead and the lower jaws on the two sides of railhead (i.e., the bottom surfaces of the railhead) after the center of top surface of the rail (i.e., the running surfaces of thre railhead) is air-cooled to 800-850° C., and to cool the rail until the center temperature of top surface is 520-550° C.;

c. Cooling stage II to stop blowing the cooling medium to the lower jaws on the two sides of railhead, to continue blowing the cooling medium to the top surface of railhead and the two sides of railhead, and to air cool the rail to room temperature after the surface temperature of railhead is cooled to 430-480° C.

Wherein, in the manufacturing method for the high-toughness and plasticity hypereutectoid rail, the composition (in weight percentage) of the rail in step a is: C: 0.86%-1.05%, Si: 0.20%-0.64%, Mn: 0.55%-0.95%, Cr: 0.20%-0.50%, at least one of V, Nb and Ti, wherein V of 0.02%-

0.10% if any, Ti of 0.001%-0.030% if any and Nb of 0.005%-0.08% if any, and the rest of Fe and inevitable impurities.

Wherein, in the manufacturing method for the high-toughness and plasticity hypereutectoid rail, the cooling medium in steps b and c is at least one of compressed air and water-air spray mixture.

Wherein, in the manufacturing method for the high-toughness and plasticity hypereutectoid rail, the cooling rate in steps b and c is 2.0-5.0° C./s.

The invention also provides a high-toughness and plasticity hypereutectoid rail, with the composition (in weight percentage) of: C: 0.86%-1.05%, Si: 0.20%-0.64%, Mn: 0.55%-0.95%, Cr: 0.20%-0.50%, at least one of V, Nb and Ti, wherein V of 0.02%-0.10% if any, Ti of 0.001%-0.030% if any and Nb of 0.005%-0.08% if any, and the rest of Fe and inevitable impurities.

Compared with the prior art, the invention has the following beneficial effects: the invention uses a rail with specific composition and adopts a method of two-stage accelerated cooling, therefore, compared with the existing single method for heat treatment, the pearlitic rail manufactured in this method has more excellent strength, hardness, toughness and plasticity, especially much better toughness and plasticity. The method of the invention can be easily conducted and has low requirement for equipment, and the high-toughness and plasticity hypereutectoid rail manufactured can enhance the overall strength and toughness of railhead and prolong the service life of rail under the same conditions.

DETAILED DESCRIPTION OF THE PREFERRED EMBODIMENTS

The invention provides a manufacturing method for a high-toughness and plasticity hypereutectoid rail, comprising the following steps:

a. Rolling of rail to hot roll steel billet into rail, with a final rolling temperature range of 900-1000° C.;

b. Cooling stage I to blow a cooling medium to the top surface of railhead, the two sides of railhead and the lower jaws on the two sides of railhead after the center of top surface of the rail is air-cooled to 800-850° C., and to cool the rail until the center temperature of top surface is 520-550° C.;

c. Cooling stage II to stop blowing the cooling medium to the lower jaws on the two sides of railhead, to continue blowing the cooling medium to the top surface of railhead and the two sides of railhead, and to air cool the rail to room temperature after the surface temperature of railhead is cooled to 430-480° C.

The high-toughness and plasticity hypereutectoid rail of the invention has the composition (in weight percentage) of: C: 0.86%-1.05%, Si: 0.20%-0.64%, Mn: 0.55%-0.95%, Cr: 0.20%-0.50%, at least one of V, Nb and Ti, wherein V of 0.02%-0.10% if any, Ti of 0.001%-0.030% if any and Nb of 0.005%-0.08% if any, and the rest of Fe and inevitable impurities.

C is the most important and cheapest element to improve strength and hardness of pearlitic rail and to promote pearlitic transformation. Under the conditions of the present invention, when the content of C is <0.86%, the rail has low strength and hardness after heat treatment and cannot meet the wear resistance required for the heavy-haul railway with high axel loads; when the content of C is >1.05%, secondary cementite will still precipitate at grain boundaries even though accelerated cooling is adopted after final rolling, thus deteriorating the toughness and plasticity of the rail. Therefore, the content of C is limited within the range of 0.86%1.05%.

As a solid-solution strengthening element of steel, Si is present in ferrite and austenite to improve strength of structure, meanwhile, it can suppress precipitation of proeutectoid cementite, thus improving the toughness and plasticity of the rail. Under the conditions of the present invention, when the content of Si is <0.20%, the solid solubility is relatively low, leading to low strengthening effects; when the content of Si is >0.64%, the toughness and plasticity of the rail degrades and the transverse performance of the rail deteriorates. Therefore, the content of Si is limited within the range of 0.20%-0.64%.

Mn can form solid solution with Fe, strengthening ferrite and austenite. Meanwhile, Mn is also a carbide former and can partially replace Fe atom after entry into cementite, improving hardness of carbide and finally improving hardness of the rail. Under the conditions of the present invention, when the content of Mn<0.55%, the strengthening effect is not obvious and the performance of steel can only be slightly improved through solid-solution strengthening; when the content of Mn is >0.95%, the hardness of the carbide in steel is too high and the toughness and plasticity significantly degrades; meanwhile, Mn has obvious diffusion effects to carbon when in steel, and the segregation zone of Mn can still produce B, M and other abnormal structures even under air-cooling conditions. Therefore, the content of Mn is limited within the range of 0.55%-0.95%.

As a medium carbide former, Cr can form multiple carbides with the carbon in the steel; meanwhile, Cr can produce even distribution of carbides in the steel, reduce the size of carbides and improve wear resistance of the rail. Under the conditions of the present invention, when the content of Cr is <0.20%, the carbide formed will have low hardness and low proportion and will aggregate in the form of sheet, in this way, the wear resistance of the rail cannot be improved effectively; when the content of Cr is >0.50%, coarse carbide is prone to form, thus deteriorating the toughness and plasticity of the rail. Therefore, the content of Cr is limited within the range of 0.20%-0.50%.

V has low solubility in steel when under room temperature, and if V is present in austenite grain boundaries and other zones during hot rolling, it is precipitated through fine-grained V carbonitride [V (C, N)] or together with Ti in steel, suppressing the growth of austenite grains and thus refining grain and improving performance. Under the conditions of the present invention, when the content of V is <0.02%, the precipitation of V carbonitride is limited and the rail cannot be strengthened effectively; when the content of V is >0.10%, coarse carbonitride is prone to form, thus deteriorating the toughness and plasticity of the rail. Therefore, the content of V is limited within the range of 0.02%-0.10%.

The main function of Ti in steel is to refine austenite grains during heating, rolling and cooling, and finally to improve extensibility and rigidity of the rail. When the content of Ti is <0.001%, the amount of carbides formed in the rail is extremely limited. Under the conditions of the present invention, when the content of Ti is >0.030%, on one hand, excessive TiC forms since Ti is a strong carbonitride former, making the hardness of the rail too high, and on the other hand, excessive TiN and TiC may lead to segregation enrichment and form coarse carbonitride, degrading the toughness and plasticity and making the contact surface of the rail prone to crack under impact load and leading to fracture. Therefore, the content of Ti is limited within the range of 0.001%-0.030%.

The main function of Nb in steel is similar to that of V, i.e., to refine austenite grains with the Nb carbonitride precipitated and to make precipitation strengthening occur with the carbonitride produced during the cooling process after rolling. Nb can improve hardness of the rail, enhance toughness and plasticity of the rail and help prevent softening of welded joints. Under the conditions of the present invention, when the content of Nb is <0.005%, the precipitation of Nb carbonitride is limited and the rail cannot be strengthened effectively; when the content of Nb is >0.08%, coarse carbonitride is prone to form, thus deteriorating the toughness and plasticity of the rail. Therefore, the content of Nb is limited within the range of 0.005%-0.08%.

The common smelting method in the art is adopted to smelt steel for the above rail: to conduct continuous casting for the molten steel in compliance with the above composition requirements to produce steel billet with the section of 250 mm×250 mm-450 mm×450 mm, cool the steel billet, put it into a heating furnace to heat to 1200-1300° C., insulate the steel billet for a certain period of time and take it out of the furnace, remove phosphorus with high-pressure water, and then roll the billet into 50-75 kg/m rail with the required section by universal rolling or groove rolling.

Currently, the main method to conduct heat treatment for rail is to carry out accelerated cooling to the railhead of the austenitic rail, while the cooling nozzles are mainly arranged on the top surface and two sides of the railhead. This is determined by the characteristics of rail: the top surface and one side of the rail bear multiple complex stress of the wheel, and the rail has a symmetrical section along the vertical direction. Both sides may be subjected to the stress of the wheel since their installation location varies. Therefore, the performance of the in-service top surface and two sides of the railhead should be higher than that of other parts of the rail.

In the process of accelerating cooling of the top surface and both sides of the railhead, with the sudden drop of surface temperature, the core of railhead transfers heat with the surface, during which process the performance of the surface of railhead will not degrade but improve with the release of latent heat during phase change of pearlite. This means the supercooling of the core of railhead drops during phase change. Eventually, under room temperature, not only the hardness of the core of the railhead is obviously lower than that of the surface, but also the toughness is relatively low. The invention adopts the method of adding nozzles at lower jaws on the two sides of railhead to blow a cooling medium. During the heat treatment, since the difference of cooling rates at core of railhead and surface of railhead decreases, the phase change of surface of railhead can start at a much lower temperature, and the toughness and plasticity of the rail can be further improved. Even though the improvement is quite limited, it can still improve the comprehensive strength and toughness of steel, such as pearlite heat-treated rail, with toughness and plasticity already reaching the limit.

In the invention, the cooling for rail is conducted in two stages. The cooling stage I is to cool "the top surface of railhead, the two sides of railhead and the lower jaws on the two sides of railhead", and to cool the rail at a cooling rate of 2.0-5.0° C./s to 520-550° C. after the rail is air-cooled to 800-850° C. By adopting the method, it is possible to get a more evenly distributed temperature field and to provide conditions for subsequent phase change. If the cooling rate is <2.0° C./s, the grains cannot be effectively refined and it is difficult to improve the toughness and plasticity simultaneously; if the cooling rate is >5.0° C./s, B, M and other abnormal structures can be easily formed. Especially after adopting accelerated cooling for the lower jaws of railhead, abnormal structures can be more easily formed since the capability to supplement heat from the core of railhead and the rail web to the surface of railhead has decreased during the accelerated cooling. Therefore, the cooling rate of the invention is set at 2.0-5.0° C./s.

The reason for cooling the lower jaws on the two sides of railhead is that: during the accelerated cooling process, the surface temperature drops rapidly under the action of the cooling medium, and the heat from the core of railhead and the rail web is continuously circulated and supplemented to the surface of railhead and a certain depth, leading to a drop of the supercooling of the core of railhead, which shows a decrease of toughness and plasticity of the rail under room temperature; if the cooling for lower jaws of railhead is adopted simultaneously, new channels for heat losses are provided for the railhead, and the heat supplement for the core of railhead is significantly reduced, thus raising the supercooling of the section of railhead, especially the core of railhead. Meanwhile, for the high carbon rail, conducting accelerated cooling at the range of 800-850° C. can effectively suppress precipitation of proeutectoid cementite, so as to avoid its distribution along grain boundaries and degradation of the rail's toughness and plasticity.

The cooling stage II is conducted when the temperature of the center of top surface of railhead drops to 520-550° C. Accelerated cooling for the lower jaws of railhead is stopped and accelerated cooling is conducted only to the top surface of railhead and the two sides of railhead, mainly because that the phase change of the surface of railhead is basically completed and the core of railhead is in phase change under the temperature range. At this time, the risk of forming abnormal structure also increases even a higher cooling rate is applied for spot segregation sites. Therefore, in the cooling stage II, the rail is cooled to 430-480° C. at the cooling rate of 2.0-5.0° C./s and is then air-cooled to room temperature. The phase change of the railhead of rail is completed within the temperature range, and straightening, flaw detection and processing, etc. are carried out in later stages to obtain finished rail.

The preferred embodiments of the invention will be further illustrated as follows, but it does not indicate that the protection scope of the invention is limited as described in the Examples.

Examples 1-6 Manufacturing Hypereutectoid Rail with the Method of the Invention The chemical composition of the steel billet for the hypereutectoid rail in Examples 1-6 is shown in table 1:

TABLE 1

List of chemical composition of the steel billet for the hypereutectoid rail (%)

| | C | Si | Mn | P | S | Cr | V/Ti/Nb |
|---|---|---|---|---|---|---|---|
| Example 1 | 0.95 | 0.37 | 0.60 | 0.010 | 0.004 | 0.37 | 0.012Ti |
| Example 2 | 0.90 | 0.58 | 0.95 | 0.011 | 0.005 | 0.20 | 0.08V |
| Example 3 | 1.05 | 0.34 | 0.55 | 0.012 | 0.007 | 0.50 | 0.03Nb |
| Example 4 | 0.92 | 0.64 | 0.73 | 0.009 | 0.006 | 0.43 | 0.08Nb |
| Example 5 | 0.86 | 0.29 | 0.78 | 0.010 | 0.005 | 0.32 | 0.026Ti |
| Example 6 | 0.97 | 0.46 | 0.85 | 0.012 | 0.006 | 0.24 | 0.02V |

The steel billets shown in the above table are all rolled into 75 kg/m rails and cooled by the following method:

a. Rolling of rail to hot roll steel billet into rail, with a final rolling temperature range of 900-1000° C.;

b. Cooling stage I to blow a cooling medium to the top surface of railhead, the two sides of railhead and the lower jaws on the two sides of railhead after the center of top surface of the rail is air-cooled to 800-850° C., and to cool the rail until the center temperature of top surface is 520-550° C.;

c. Cooling stage II to stop blowing the cooling medium to the lower jaws on the two sides of railhead, to continue blowing the cooling medium to the top surface of railhead and the two sides of railhead, and to air cool the rail to room temperature after the surface temperature of railhead is cooled to 430-480° C.

The cooling rate in Examples 1-6 is shown in table 2.

TABLE 2

Cooling Rate under Different Methods

| | Temperature for air cooling/ ° C. | Average accelerated cooling rate at the cooling stage I ° C./s | Final temperature to end accelerated cooling at the cooling stage I/° C. | Final temperature to end Final temperature for accelerated cooling/° C. |
|---|---|---|---|---|
| Example 1 | 831 | 3.8 | 550 | 473 |
| Example 2 | 850 | 4.3 | 536 | 467 |
| Example 3 | 839 | 5.0 | 520 | 430 |
| Example 4 | 816 | 2.0 | 545 | 445 |
| Example 5 | 800 | 2.9 | 528 | 480 |
| Example 6 | 838 | 3.4 | 539 | 438 |

Comparative Examples 1-6 Manufacturing Hypereutectoid Rail with Existing Methods The composition of the steel billet used in Comparative Examples 1-6 is the same as that of Examples 1-6, wherein the steel billet of Comparative Example 1 is the same as that of Example 1, and so forth.

Comparative Examples 1-6 adopt an existing cooling method as follows: a cooling medium is blown only to the top surface of railhead and the two sides of railhead, and the rail is air-cooled to room temperature after the surface of railhead is cooled to 430-480° C.

The cooling rate in Comparative Examples 1-6 is shown in table 3:

TABLE 3

Cooling Rate under Different Methods

| Joint | Average accelerated cooling rate at the cooling stage I ° C./s | Final temperature to end Final temperature for accelerated cooling/ ° C. |
|---|---|---|
| Comparative Example 1 | 3.8 | 474 |
| Comparative Example 2 | 4.4 | 465 |
| Comparative Example 3 | 5.0 | 431 |
| Comparative Example 4 | 2.1 | 447 |
| Comparative Example 5 | 2.8 | 482 |
| Comparative Example 6 | 3.3 | 437 |

Air cool the rail treated according to the Examples and the Comparative Examples to room temperature, take double-shoulder circular tensile specimen with $d_0$=10 mm, $l_0$=5$d_0$ 10 mm and 30 mm below the surface of railhead of the rail respectively, and detect $R_{p0.2}$, $R_m$, A and Z respectively according to GB/T 228.1; and take U-type Charpy impact specimen of 10 mm×10 mm×55 mm at the same position, and detect impact energy according to GB/T 229. Besides, take transverse hardness specimen from the railhead of rail respectively, and test Rockwell hardness respectively at the upper corner and the center of the top surface at 10 mm and 30 mm from the surface of railhead according to GB/T 230.1. The test positions and methods are the same for the Examples and the Comparative Examples. The detailed results are shown in Tables 4 and 5.

TABLE 4

Mechanical Properties of Rails Prepared with Different Methods (10 mm below the surface of railhead)

| | Tensile properties | | | | Room temperature | Hardness/HRC | |
|---|---|---|---|---|---|---|---|
| | Rp/MPa | Rm/MPa | A/% | Z/% | Aku/J | Corner | Top surface |
| Example 1 | 842 | 1407 | 11.5 | 24 | 19 | 41.0 | 40.8 |
| Example 2 | 839 | 1384 | 12.0 | 23 | 21 | 39.8 | 39.9 |
| Example 3 | 857 | 1427 | 11.5 | 20 | 19 | 41.4 | 41.5 |
| Example 4 | 818 | 1369 | 11.5 | 21 | 20 | 40.2 | 40.1 |
| Example 5 | 825 | 1352 | 12.0 | 24 | 20 | 39.3 | 39.0 |
| Example 6 | 860 | 1411 | 11.5 | 23 | 18 | 40.8 | 40.7 |
| Comparative Example 1 | 827 | 1369 | 11.5 | 20 | 17 | 40.1 | 40.0 |
| Comparative Example 2 | 821 | 1352 | 12.5 | 24 | 20 | 39.6 | 39.4 |
| Comparative Example 3 | 849 | 1402 | 10.5 | 18 | 15 | 41.2 | 41.1 |
| Comparative Example 4 | 850 | 1368 | 11.0 | 18 | 16 | 39.1 | 39.0 |
| Comparative Example 5 | 809 | 1328 | 11.0 | 19 | 17 | 38.4 | 38.3 |
| Comparative Example 6 | 858 | 1403 | 10.0 | 20 | 16 | 40.1 | 40.3 |

TABLE 5

Mechanical Properties of Rails Prepared with Different Methods (30 mm below the surface of railhead)

| | Tensile properties | | | | Room temperature | Hardness/HRC | |
|---|---|---|---|---|---|---|---|
| | Rp/MPa | Rm/MPa | A/% | Z/% | Aku/J | Corner | Top surface |
| Example 1 | 838 | 1329 | 12.0 | 25 | 21 | 40.0 | 40.2 |
| Example 2 | 795 | 1302 | 11.5 | 23 | 21 | 38.6 | 38.4 |
| Example 3 | 824 | 1362 | 11.5 | 21 | 22 | 38.6 | 38.7 |
| Example 4 | 791 | 1296 | 11.5 | 20 | 21 | 37.4 | 37.3 |
| Example 5 | 763 | 1265 | 12.0 | 24 | 23 | 36.5 | 36.6 |
| Example 6 | 818 | 1367 | 10.5 | 20 | 23 | 40.0 | 39.8 |
| Comparative Example 1 | 761 | 1270 | 10.5 | 20 | 19 | 36.7 | 36.5 |
| Comparative Example 2 | 750 | 1251 | 11.0 | 21 | 21 | 36.4 | 36.2 |
| Comparative Example 3 | 763 | 1291 | 10.5 | 18 | 16 | 37.1 | 37.0 |
| Comparative Example 4 | 752 | 1265 | 10.0 | 15 | 17 | 36.1 | 36.2 |
| Comparative Example 5 | 735 | 1240 | 10.0 | 20 | 17 | 35.1 | 35.3 |
| Comparative Example 6 | 801 | 1330 | 10.0 | 16 | 18 | 39.5 | 39.8 |

It can be concluded from the above Examples and Comparative Examples that, the invention compares the Examples adopting the heat treatment technique of the invention with the Comparative Examples adopting existing heat treatment technique for the material with the same chemical composition. The Examples adopt the method of two-stage accelerated cooling: a cooling medium is blown to the top surface of railhead, the two sides of railhead and the lower jaws on two sides of railhead after the heat treated rail is air-cooled to 800-850° C., the accelerated cooling for the lower jaws of railhead is stopped after the center temperature of the center of top surface of railhead is cooled to 520-550° C. at a cooling rate of 2.0-5.0° C./s, and the rail is air-cooled to room temperature until the center temperature of the center of top surface of railhead drops to 430-480° C. In comparison, the existing technique adopts a single heat treatment method for the top surface of railhead and the two sides of railhead at a cooling rate of 2.0-5.0° C./s. The comparison results in tables 4 and 5 indicate that the strength, hardness, toughness and plasticity for the parts within 10 mm below the surface of the railhead under the technique of the invention are slightly higher than those of the Comparative Examples; more importantly, the toughness and plasticity of the parts at 30 mm below the surface of the railhead is obviously higher than those under existing heat treatment technique. Thus, it can be concluded that, adding accelerated cooling for the lower jaws of railhead can enhance the overall strength and toughness of railhead and prolong the service life of rail under the same conditions.

In conclusion, with the same composition and the same manufacturing technique, the manufacturing method for the high-toughness and plasticity hypereutectoid rail of the invention can improve the toughness and plasticity of rail. The product is suitable for heavy-haul railway with high requirements for wear resistance.

What is claimed is:

1. A manufacturing method for high-toughness and plasticity hypereutectoid rail, said manufacturing method comprising the following sequential steps:

(a) hot rolling a steel billet to form a rail with a final rolling temperature range of 900-1000° C.;

(b) air cooling the rail until a running surface of a railhead of the rail is cooled to 800-850° C.;

(c) blowing a cooling medium to a top surface of the railhead of the rail, two sides of the railhead and bottom surface of the railhead until the running surface of the railhead of the rail is cooled to 520-550° C.;

(d) terminating the blowing of the cooling medium to the bottom surfaces of the railhead and continuing the blowing of the cooling medium to the top surface of railhead and the two sides of railhead until the running surface of the railhead of the rail is cooled to 430-480° C.; and (e) further air cooling the rail to room temperature.

2. The manufacturing method according to claim 1, wherein the rail comprises:

(i) 0.86 wt. % to 1.05 wt. % C;

(ii) 0.20 wt. % to 0.64 wt. % Si;

(iii) 0.55 wt. % to 0.95 wt. % Mn;

(iv) 0.20 wt. % to 0.50 wt. % Cr;

(v) at least one of 0.02 wt. % to 0.10 wt. % V, 0.001 wt. % to 0.030 wt. % Ti and 0.005 wt. % to 0.08 wt. % Nb; and (vi) Fe.

3. The manufacturing method according to claim 1, wherein the cooling medium is at least one of compressed air and a water-air spray mixture.

4. The manufacturing method according to claim 1, wherein a cooling rate in steps (c) and (d) is 3.0-7.0° C/s.

5. A high-toughness and plasticity hypereutectoid rail manufactured by the manufacturing method according to claim 1, wherein the rail comprises:

(i) 0.86 wt. % to 1.05 wt. % C;

(ii) 0.20 wt. % to 0.64 wt. % Si;

(iii) 0.55 wt. % to 0.95 wt. % Mn;

(iv) 0.20 wt. % to 0.50 wt. % Cr;

(v) at least one of 0.02 wt. % to 0.10 wt. % V, 0.001 wt. % to 0.030 wt. % Ti and 0.005 wt. % to 0.08 wt. % Nb; and (vi) Fe.

* * * * *